US005483903A

United States Patent [19]

Pierce et al.

[11] Patent Number: 5,483,903

[45] Date of Patent: Jan. 16, 1996

[54] TABLE

[75] Inventors: Paul M. Pierce, Grand Haven; Randall W. Borgman, Holland, both of Mich.

[73] Assignee: Haworth, Inc., Holland, Mich.

[21] Appl. No.: 258,101

[22] Filed: Jun. 10, 1994

[51] Int. Cl.[6] ..... A47B 9/00

[52] U.S. Cl. ..... 108/147; 108/108

[58] Field of Search ..... 108/147, 144, 108/150, 108; 248/404, 161, 188.5; 312/223.3

[56] References Cited

U.S. PATENT DOCUMENTS

| | | | |
|---|---|---|---|
| 2,678,859 | 5/1954 | Zuzzi . | |
| 3,587,482 | 6/1971 | Wieland | 108/147 |
| 3,862,735 | 1/1975 | Cohen . | |
| 3,908,565 | 9/1975 | Burnett | 108/147 |
| 3,932,009 | 1/1976 | Zollinger . | |
| 4,050,752 | 9/1977 | Dykstra | 108/147 X |
| 4,493,469 | 1/1985 | Holobaugh . | |
| 4,619,427 | 10/1986 | Leymann | 248/188.5 X |
| 4,714,025 | 12/1987 | Wallin et al. | 108/147 X |
| 4,819,900 | 4/1989 | Funk | 108/108 X |
| 5,022,541 | 6/1991 | White | 108/108 X |
| 5,024,167 | 6/1991 | Hayward | 108/50 |
| 5,088,420 | 2/1992 | Russell | 108/106 |
| 5,243,921 | 9/1993 | Kruse et al. . | |

FOREIGN PATENT DOCUMENTS

| | | | |
|---|---|---|---|
| 145410 | 7/1985 | European Pat. Off. | 312/223.3 |
| 442317 | 8/1991 | European Pat. Off. | 108/147 |
| 2341290 | 9/1977 | France | 108/108 |
| 3438862 | 4/1986 | Germany | 108/144 |

*Primary Examiner*—Peter M. Cuomo
*Assistant Examiner*—Janet M. Wilkens
*Attorney, Agent, or Firm*—Flynn, Thiel, Boutell & Tanis

[57] ABSTRACT

A table having a worksurface mounted to and cantilevered forwardly from a pair of telescopic height-adjustable legs. Each leg includes an upper elongate tubular leg part which is fixed to the table top adjacent a rear corner thereof. This upper tubular leg part preferably projects upwardly at least a limited vertical extent above the upper surface of the top and terminates in a visible top cap. The upper leg part projects downwardly below the table top and is telescoped onto and around a lower elongate leg part which projects upwardly into the upper leg part. This lower leg part in turn has the lower end thereof fixed to a support foot which bears on a support surface such as a floor. A height-adjusting mechanism projects interiorly of and generally vertically between the upper and lower leg parts.

6 Claims, 3 Drawing Sheets

FIG. 3
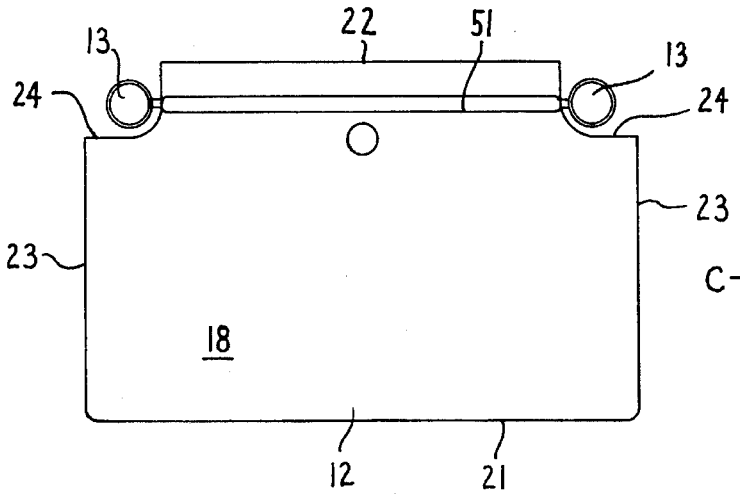
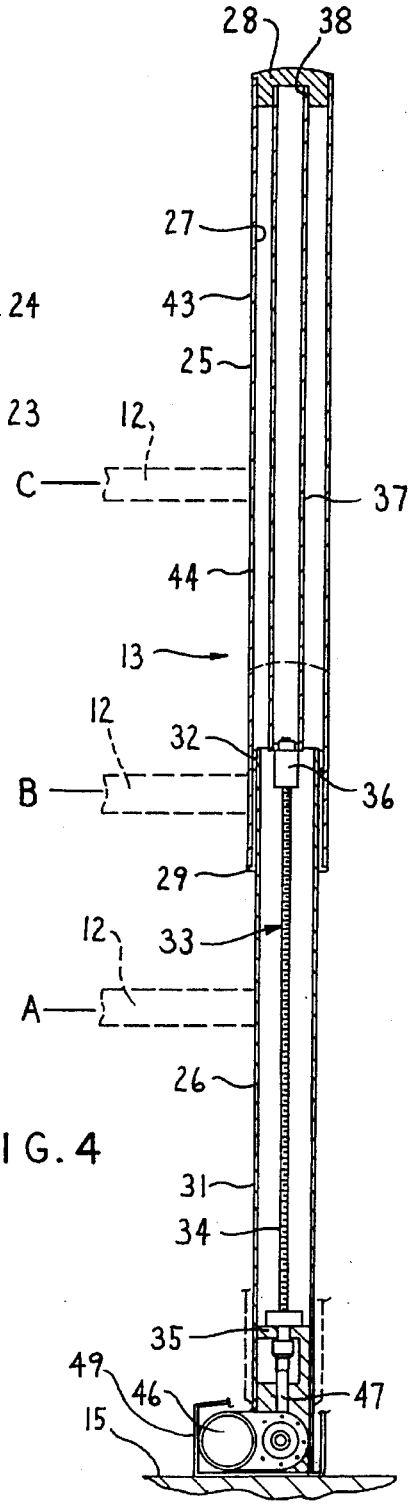
FIG. 4

TABLE

FIELD OF THE INVENTION

This invention relates to a table and, more specifically, a table having an enlarged worksurface cantilevered from a pair of upright height-adjustable telescopic legs.

BACKGROUND OF THE INVENTION

Tables are extensively utilized in work environments such as offices and the like. While tables having height adjustability are known and have been utilized in such environment for many years, nevertheless the increased demands imposed on workers with respect to flexibility and adaptability of work space has likewise imposed increased demands on the flexibility and adaptability of equipment used in the work space, including tables. These demands require not only the ability to adjust the height of a table, but require that the height often times be adjustable over a greater range including a demand that the height be adjustable from a sitting height to a standing height. At the same time such adjustability must be able to be carried out frequently and efficiently without requiring complex or difficult mechanical maneuvers, while providing a table having the required strength and durability to function in the desired manner.

In addition, many tables have been developed which employ an enlarged top or worksurface which is cantilevered forwardly from a pair of height-adjustable legs, which legs are generally positioned adjacent the rear corners of the table so as to maximize the clearance space under the front side of the table to prevent interference with the legs of a user. Most of these tables have employed telescopic leg structures wherein an upper leg part is fixed to the underside of the worksurface and telescopes downwardly into a lower leg part which is fixed to an enlarged support foot which engages the floor. These telescopic leg structures are often provided with some type of a mechanism, such as a screw drive, which is either manually or power driven to provide height adjustment through a limited stroke which is normally a matter of a small number of inches. In the past the height adjustment has typically been about eight to ten inches although some have been as much as 14 inches.

Accordingly, it is an object of the present invention to provide an improved table having a worksurface which is mounted to and cantilevered forwardly from a pair of telescopic height-adjustable legs, which table provides highly improved operational advantages in addition to providing desirable structural relationships for the height-adjusting legs, and in addition provides for improved aesthetics of the table.

More specifically, in the improved table of the present invention, the height-adjusting legs each includes an upper elongate tubular leg part which is fixed to the table top adjacent a rear corner thereof, with this upper tubular leg part projecting upwardly at least a limited vertical extent above the upper surface of the top so as to terminate in a visible top cap. This elongate upper leg part in turn projects downwardly below the table top and is telescoped onto and around a lower elongate leg part which projects upwardly into the upper leg part. This lower leg part in turn has the lower end thereof fixed to a support foot which bears on a support surface such as a floor. A height-adjusting mechanism projects interiorly of and generally vertically between the upper and lower leg parts.

An advantageous feature of the table of the present invention, as aforesaid, is the upward extension of the upper leg parts above the table top through a sufficient vertical extent as to permit components such as shelves, privacy screen, etc. to be mounted on and extend horizontally between the projecting portions of the upper leg parts, whereby the component is disposed substantially adjacent and projects upwardly adjacent the rear edge of the table top.

A further advantageous feature of the table of the present invention, as aforesaid, is the provision of a height-adjustment stroke which enables the table top to be vertically adjusted through a long stroke which accommodates both a sitting-height position and a standing-height position for the worker, with the height difference between these positions typically being about equal to or greater than the height of the table top when in the lowermost sitting position.

Still a further advantageous feature of the table according to the present invention, as aforesaid, is that the drive mechanism which connects and controls the telescopic extension or contraction of the upper and lower leg parts is a single stage drive mechanism which, due to its cooperation with the upper and lower leg parts, enables the height-adjustment stroke between the upper and lower positions to be approximately equal to or greater than the height between the floor and the table top when the latter is in its lowest position.

Other objects and purposes of the present invention will be apparent to persons familiar with structures of this general type upon reading the following specification and inspecting the accompanying drawings.

BRIEF DESCRIPTION OF THE DRAWINGS

FIG. 3 is a top view thereof;

FIG. 4 is an enlarged sectional view of the telescopic leg in an extended position, and diagrammatically showing different worksurface heights;

Figure 2:
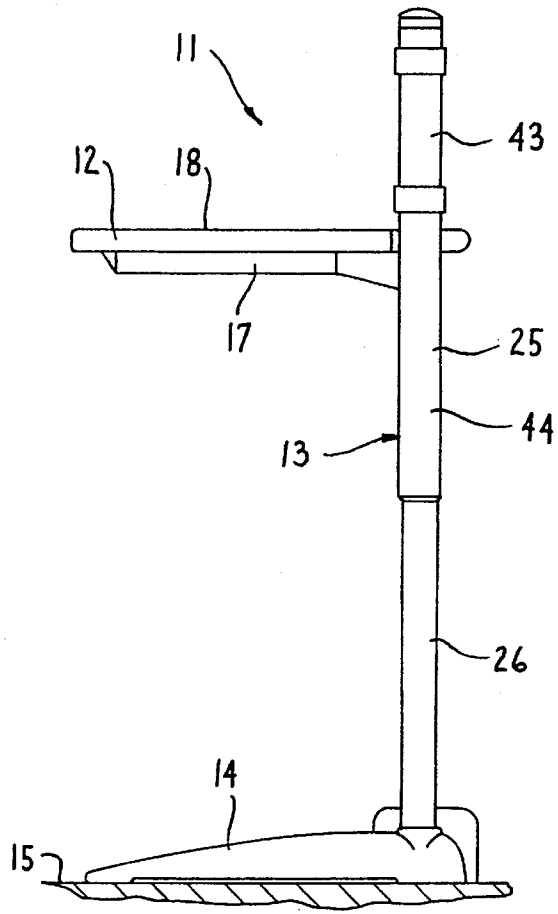
FIG. 2 is a side elevational view thereof.
Figure 1:
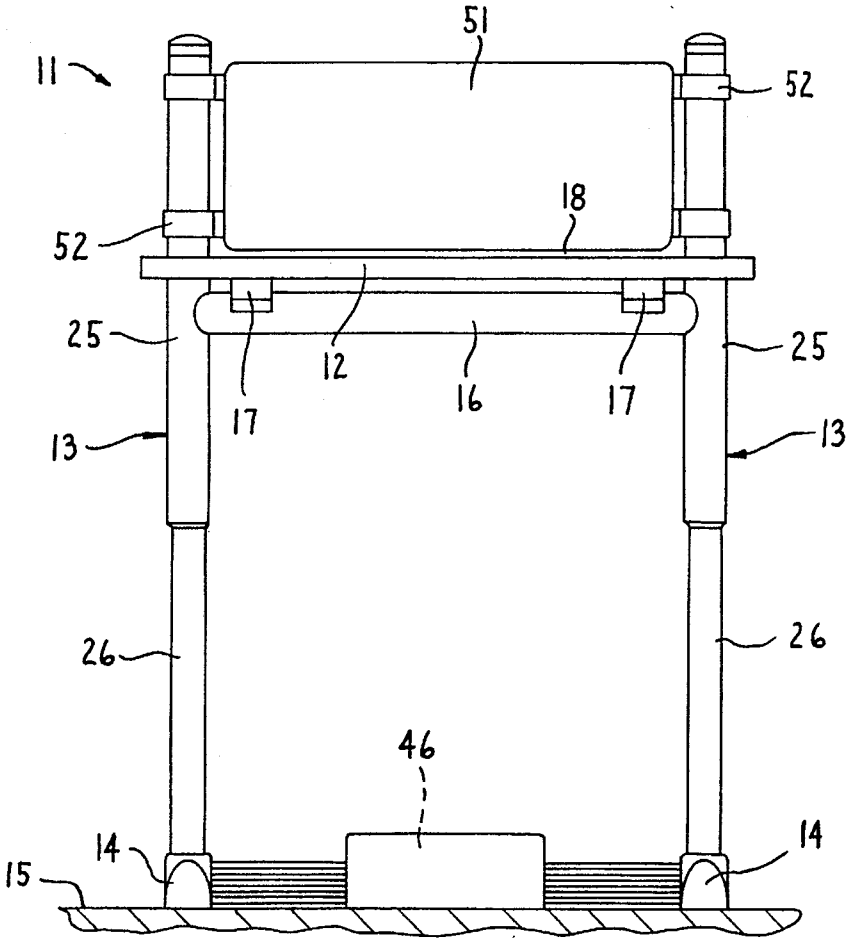
FIG. 1 is a front elevational view of a table according to the present invention.

Certain terminology will be used in the following description for convenience in reference only, and will not be limiting. For example, the words "upwardly", "downwardly", "rightwardly" and "leftwardly" will refer to directions in the drawings to which reference is made. These latter terms will also refer to the normal directional relationships utilized in conjunction with the table during normal usage thereof. The words "inwardly" and "outwardly" will refer to directions toward and away from, respectively, the geometric center of the table and designated parts thereof. Said terminology will include the words specifically mentioned, derivatives thereof, and words of similar import.

DETAILED DESCRIPTION

Referring to the drawings, there is illustrated a table 11 according to the present invention. This table 11 includes a top or worksurface 12 which is supported in a cantilevered relationship from a pair of height-adjustable legs 13. The legs 13 have the lower ends thereof joined to supports or feet 14 which project horizontally from the legs for supportive engagement with a support surface such as a floor 15. A cross bar 16 is horizontally rigidly joined between the legs 13, and this cross bar 16 in turn rigidly mounts thereon a pair of generally parallel cantilevered support arms 17 which project horizontally forwardly and supportingly engage the underside of the worksurface 12.

The top or worksurface 12 is of a platelike construction having a horizontally enlarged planar top surface 18 which functions as a working surface. The worksurface 12, in the illustrated embodiment, has a generally horizontally enlarged rectangular configuration which is defined between generally parallel front and rear edges 21 and 22, respectively, and a pair of generally parallel side edges 23 which extend generally perpendicularly between the front and rear edges.

The worksurface 12, in a preferred embodiment of the invention, also has recesses or cutout regions 24 defined at the rear corners thereof, namely the corners which would normally be defined by intersection of the rear and side edges 22 and 23. These recesses or cutout regions 24 are provided so as to accommodate therein the upwardly projecting legs 13, whereby these legs are accommodated within the generally rectangular profile defined by the edges of the worksurface 12, with the legs 13 projecting upwardly above the upper working surface 18.

The height-adjustable legs 13 are substantially identical and project vertically upwardly in generally parallel relationship along the respective longitudinal axes 19, which axes 19 project generally vertically in substantially perpendicular relationship to the horizontal plane defined by the working surface 18.

Each height-adjustable leg 13 includes an upper vertically-elongate leg part 25 which is formed as an elongate tube, and it telescopically and movably cooperates with a lower vertically-elongate leg part 26, the latter also being an elongate tube.

The upper leg part 25 defines therein a cylindrical opening 27 which projects therethrough, with the upper end of this leg part 25 being closed by a suitable cap 28 which is fixed thereto, such as by screws (not shown). Upper leg part 25 also has an annular bearing structure, specifically a cylindrical bushing 29, which is fixed interiorly of the upper leg part adjacent the lower free end thereof.

The lower leg part 26 has the lower end thereof fixedly secured to the respective support foot 14, with the lower leg part 26 projecting vertically upwardly therefrom in concentric relationship about the longitudinal axis 19. This lower leg part 26 defines thereon an outer annular wall 31, which wall is cylindrical in the illustrated and preferred embodiment. An annular bearing, preferably a cylindrical bushing 32, externally surrounds and is fixedly secured to the lower leg part 26 adjacent the upper free end thereof.

The annular bushing 32 as fixed to the upper free end of the lower leg part 26 has an exterior cylindrical bearing surface which is adapted to snugly but freely axially slidably engage the interior cylindrical wall 27 of the upper leg part 25. Similarly, the cylindrical bushing 29 as fixed adjacent the lower end of the upper leg part 25 has an interior cylindrical bearing surface which is adapted to snugly but freely axially slidably engage the exterior cylindrical wall 31 of the lower leg part 26. Further, as illustrated by FIGS. 4–6, the lower leg part 26 projects concentrically and coaxially upwardly into the interior of the upper leg part 25 through a sufficient extent at all times so as to ensure that the upper bushing 32 is always disposed in upwardly coaxially spaced relationship relative to the lower bushing 29 to hence provide for a proper slidable support of the upper and lower leg parts 25 and 26 with respect to one another while maintaining a proper cantilevered slide-bearing relationship therebetween.

Each leg 13 as defined by the cooperating upper and lower leg parts 25 and 26 also includes a vertically elongate drive assembly 33 positioned coaxially within and extending longitudinally throughout substantially the entire height of the leg 13. This drive assembly 33 includes an elongate drive shaft 34 which is preferably formed with an exterior drive screw or thread formed thereon, with this drive shaft 34 projecting coaxially along the axis 19. This elongate drive shaft 34 projects coaxially throughout substantially the entire length of the lower leg part 26, and the lower end of this drive shaft 34 is rotatably supported with respect to the surrounding leg part 26 by means of a suitable bushing or bearing 35.

The drive assembly 33 also includes an annular nut 36 which is engaged with the elongate drive shaft 34, which shaft 34 and nut 36 preferably comprises a conventional recirculating ball nut-screw device. The nut 36 is nonrotatably secured to the lower end of an elongate support or lift tube 37 which concentrically surrounds at least an upper portion of the drive shaft 34, with this hollow lift tube 37 projecting upwardly in concentric relationship to the axis 19. The lift tube 37 has a length which extends throughout substantially the entirety of the upper leg part 25, with the upper end of the lift tube 37 in the illustrated embodiment being positioned within a cylindrical opening or recess 38 as defined on the lower end of the cap 28. This cap 28 has a cylindrical hub part 39 which snugly fits downwardly into the opened upper end of the upper leg part 25.

Figure 5:
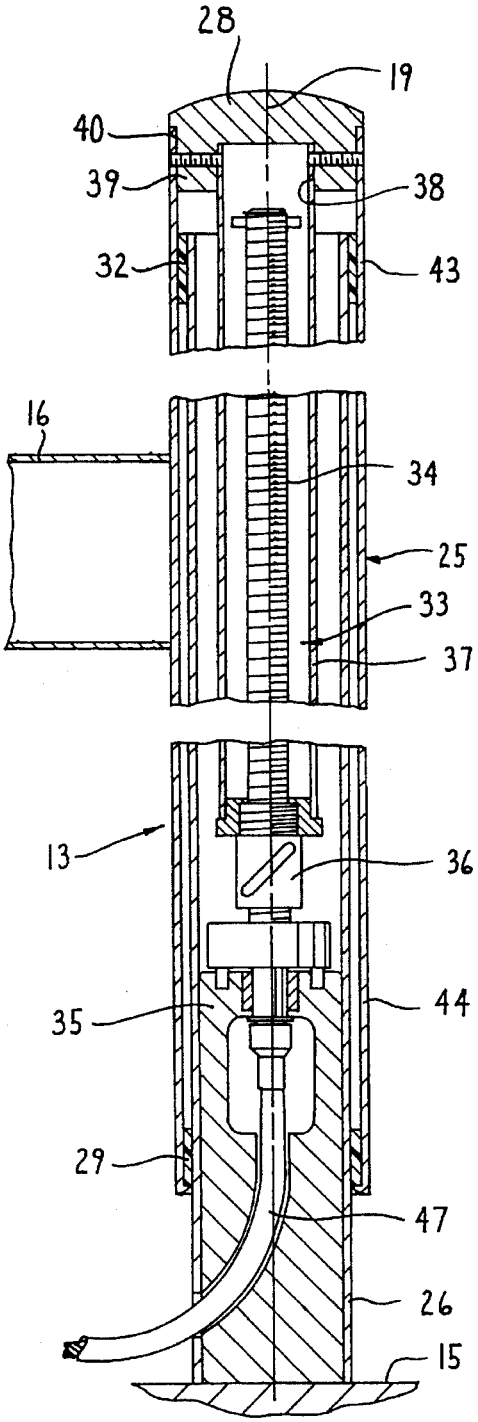
FIG. 5 is an enlarged fragmentary sectional view of the telescopic leg shown in its lowermost or fully contracted position.
Figure 6:
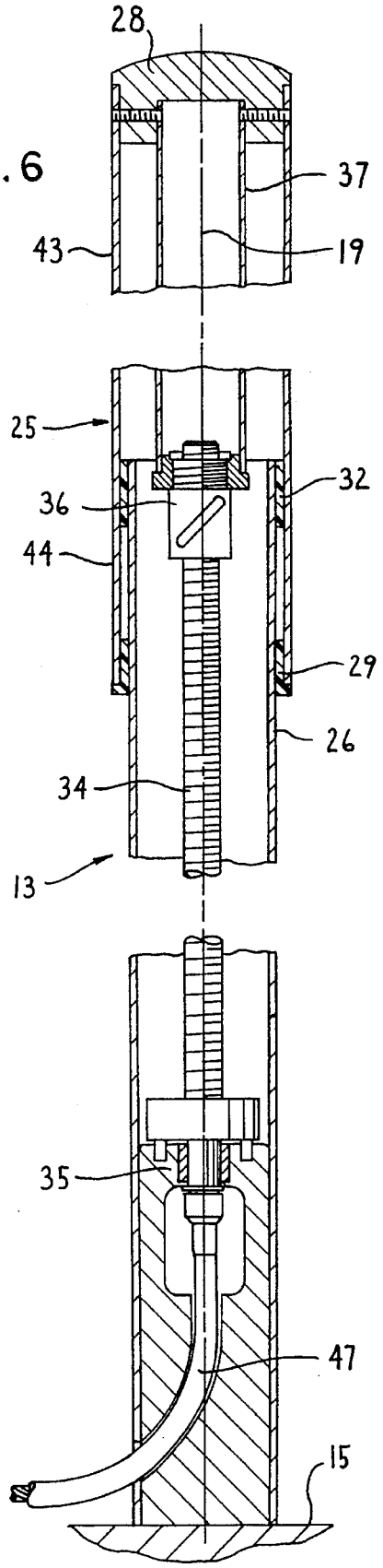
FIG. 6 is a view similar to FIG. 5 but showing the leg in its uppermost or fully extended position.

As illustrated by FIGS. 5 and 6, the upper leg part 25 and the cap 28 and the lift tube 37 are suitably connected, both axially and nonrotatably, by a securing pin 40 which is accommodated in aligned openings which project radially through these members.

The connection of the upper end of the lift tube 37 to the cap 28 by the securing pin 40 is preferably provided with sufficient clearance to permit limited movement of the lift tube relative to the cap. That is, there is preferably initially provided at least some limited relative moment of the lift tube along the securing pins 40 so as to facilitate alignment of the lift tube with the drive screw during initial assembly. The pins 40 are also preferably oriented so that the axial direction thereof projects generally horizontally in the lengthwise direction of the table, that is generally parallel with the cross bar 16, so as to allow the lift tube 37 to have a small angular movement about the pins 40 so as to permit the lift tube to align with the drive screw 34, even under conditions where the table leg, in the fully extended position, may undergo limited deflection, such as forward deflection due to the cantilevered loading created by the worksurface. For this purpose, the lower support bushing for the drive screw 34 also generally has limited clearance which likewise permits the drive screw to undergo a very small angular movement so that it also tends to self-align with the lift tube and the nut mounted thereon. In this manner, the cooperation between the drive screw, nut and lift tube permits some self-alignment so as to compensate for bending load-induced deflection of the legs particularly when in fully extended positions.

The above relationship and the ability of the drive screw and lift tube to at least partially self-align and effectively be isolated from and thus compensate for bending of the leg tubes also enables the overall leg tubes themselves to be constructed from standard components so that the overall leg assembly can be constructed with less stringent tolerances because of the ability of the drive screw and lift tube to conform or align even though the overall leg may be subjected to a minor degree of nonconcentricity and/or load-induced bending-type deflection.

The upper leg part 25 of each leg 13, as shown in FIG. 3, is positioned so as to project vertically upwardly through the recess or cutout 24 as provided adjacent the respective corner of the worksurface 12, whereby the upper leg part 25 and hence the overall leg 13 thus projects upwardly above the working surface 18.

More specifically, the upper leg part 25 has the cross bar 16 fixedly secured thereto at a middle portion thereof, namely at a location which is disposed a substantial distance from the free upper and lower ends of the upper leg part 25, so that the cross tube 16 projects generally horizontally in perpendicular relationship to the axes of the upper leg parts 25. The upper leg parts 25 are thus rigidly joined to opposite ends of the cross bar 16 and define a generally H-shaped rigid structure. This connection of the upper leg parts 25 to the cross bar 16, which cross bar 16 is disposed at an elevation which is substantially at or only slightly below the under or bottom surface of the worksurface 12, results in each upper leg part 25 having an upper portion 43 which projects upwardly from the cross bar through the respective corner cutout 24 to an elevation disposed above the planar top surface 18. Similarly, the upper leg part 25 has a lower tubular portion 44 which projects downwardly from the top surface 18 and downwardly from the cross bar toward the floor.

In the table 11 as illustrated herein, the drive assemblies 33 as associated with the legs 13 are preferably power driven so as to permit synchronous extension or contraction of the legs 13 when adjusting of the height of the worksurface 12 is desired. For this powered driving of the drive assemblies 33, there is provided a conventional electric motor 46 which couples through suitable speed reduction gearing to flexible drive shafts 47 which project outwardly and are joined to the lower ends of the elongate drive shafts 34 to effect rotation thereof when desired. The motor in the illustrated embodiment is positioned so as to rest on the floor generally centrally under the table, and the flexible shafts 47 are suitably enclosed by a shroud which projects sidewardly from the motor for connection to the support feet 14. The motor can be suitably enclosed within a housing 49. The motor is typically a reversible type which permits rotational driving of the drive shafts in either rotational direction depending upon whether lifting or lowering of the worksurface 12 is desired. Such powered driving arrangements as provided for varying the height of table worksurfaces are conventional.

In the table 11 according to a preferred embodiment of the invention, the height-adjusting legs 13 are configured so as to permit the height of the worksurface 12 to be adjusted over a significant vertical extent, preferably not only through a typical range which would accommodate typical seated working positions, but also over a range which will also accommodate a standing working position. For example, for a typical seated working position, the vertical height adjustment will typically be in the order of eight to ten inches, such as from a lower seated height of about 22 inches to an upper seated height of about 32 inches. These two positions are respectively illustrated by the positions A and B shown in FIG. 4. The legs 13 of this invention, however, are also configured so as to permit the worksurface 12 to be adjusted to a standing height position which is illustrated by the position C in FIG. 4 and which corresponds to a height suitable to permit use of the table by an operator or user who is standing. For example, this standing height position may correspond to a height as great as 49 inches above the floor 15.

Accordingly, the upper leg parts 25 are of sufficient length and positional relationship relative to the worksurface 12 such that the upper portions 43 of the upper leg parts 25 project upwardly a significant extent above the top surface 18. In fact, the upper portions 43 of the upper leg parts 25 preferably have a vertical extent above the top surface 18 which is at least about one-third of the overall length of the upper leg part 25, and in fact this vertical extent above top surface 18 may be approximately one-half of the overall length of the upper leg part 25, as diagrammatically illustrated in FIG. 4.

At the same time, in order to accommodate a large stroke, particularly the stroke required for movement between a lowermost sitting position A and an uppermost standing position C, which stroke may approximately equal or exceed the height of the sitting position A, the lower leg part 26 also has an overall length such that the upper free end thereof is disposed at an elevation above the top surface 18 when the latter is in the lowermost position A.

With the table 11 according to the present invention, the upwardly extending leg portions 43 which project above the top surface 18 also enable a vertically enlarged divider member or other furniture component 51 to be mounted so as to extend horizontally therebetween. Such member 51 can be secured to the leg portions 43 by suitable brackets or straps 52. The member 51 will normally be positioned so that the lower edge thereof is disposed closely adjacent the top surface 18 in the vicinity of the rear edge of the worksurface, with the member 51 projecting upwardly through a significant vertical extent. The member 51 may comprise any suitable component such as a privacy screen, an acoustical pad, a tack board, a shelf, or a grid or similar structure which permits mounting of suitable components thereon, such as paper handling elements and the like.

With the table 11 of the present invention, the height of the worksurface 12 can be easily and efficiently adjusted over a wide range, which height-adjustment range in the preferred embodiment of the invention will be of a magnitude similar to, or may exceed, the minimum height position of the worksurface. For example, the worksurface 11 can be easily adjusted throughout the normal sitting height range such as depicted by the lowermost position A and the intermediate position B, and can also be easily adjusted upwardly into a standing height position as depicted by position C. Such height adjustment can be easily accomplished by energizing the motor in the proper direction depending upon whether raising or lowering is desired, which motor acting through the flexible drive shafts causes corresponding rotation of the drive screws 34 associated with the legs 13. The rotatable drive screws react with the nonrotatable nuts 36, causing the lift tubes 37 to be appropriately raised or lowered, causing corresponding raising or lowering of the worksurface 12. During such raising or lowering, the two sleeve bushings provide proper slidable guiding and support between the upper and lower leg parts 25 and 26. Even when the worksurface is in the uppermost position as indicated at position C, the two sleeve bearings, while at their minimum axially spaced position, still provide a significant resistive moment to provide proper support for the upper leg part in its fully extended position.

Due to the configuration of the telescopic legs 13 and particularly the manner in which the upper leg part 25 has a significant portion which permanently projects upwardly above the worksurface, and the fact that the lower leg part 26 also has an upper portion which may project upwardly above the worksurface when the worksurface is in the lowermost position A, this enables the worksurface to have a large vertical height adjustment capability to thus greatly increase the ability of the table to accommodate a wide range of working positions, including both standing and sitting work positions. Further, such capability is accomplished using a single stage height-adjusting drive mechanism, thereby avoiding or eliminating the requirement that several such mechanisms be telescopically coupled in series.

While the invention discloses the table with the drive screw preferably being rotatably but axially fixedly positioned relative to the lower leg part and the nut carried by and movable vertically with the upper leg part, it will be appreciated that such positional relationship can under certain circumstances be reversed.

The invention discloses the table top as being of rectangular shape. However, it will be apparent that the top can assume many other shapes without departing from the invention.

In addition, the tubular elements defining the upper and lower leg parts can be of noncircular cross sections so long as they properly telescopically cooperate.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A table comprising:

a horizontally enlarged platelike worksurface defining thereon an upwardly facing top surface, said worksurface including front and rear edges;

a pair of generally parallel height-adjusting upright legs, said legs being disposed adjacent opposite sides of said worksurface;

a supporting structure fixed to said legs and positioned directly under said worksurface in supporting engagement therewith, said supporting structure including a cross bar which is fixed to and extends between said legs;

each said upright leg including vertically elongate upper and lower tubular leg parts disposed in coaxial and telescopic relation, said upper leg part being fixed to said supporting structure at a location intermediate the ends thereof so that said upper leg part includes upper and lower elongate portions which respectively project upwardly and downwardly from said supporting structure, said elongate upper portion projecting vertically upwardly above the top surface of said worksurface;

a floor-engaging support foot fixedly mounted to a lower end of each said lower leg part;

said lower leg part projecting coaxially upwardly into the interior of said upper leg part with said lower leg part terminating in an upper free end, said lower leg part projecting coaxially upwardly a sufficient vertical extent so that the upper free end thereof is disposed at an elevation above the top surface when the worksurface is in a lowermost position;

an elongate drive mechanism extending coaxially of each said leg for effecting raising and lowering of the upper leg part to adjust the vertical height position of the worksurface between said lowermost position and an uppermost position;

said drive device including an elongate rotatable drive screw which projects coaxially of one of the upper and lower leg parts and is axially anchored adjacent one end thereof to the respective leg part, said drive screw adjacent the other end thereof being engaged with a nut member which is coupled to one end of an elongate support tube which projects coaxially of the other leg part, said support tube adjacent the other end thereof being nonrotatably and axially anchored relative to said other leg part.

2. A table according to claim 1, wherein said platelike worksurface has cutout recesses formed therein adjacent rear corners thereof, and each said leg having the respective upper leg part positioned so as to project upwardly through a respective one of the corner cutout recesses so that the upper leg part projects above the top surface of the worksurface.

3. A table according to claim 1, wherein the vertical height between the uppermost and lowermost positions is approximately equal to or exceeds the vertical distance between the floor and the top surface when the worksurface is in said lowermost position, wherein the upper leg part has an upper tubular portion projecting upwardly above the top surface and is at least about one-third of the overall length of the upper leg part.

4. A table according to claim 3, wherein the upper leg part has an overall vertical length which is at least approximately equal to or greater than said vertical distance.

5. A table according to claim 4, wherein the upper tubular portion of said upper leg part has a length which is about one-third to about one-half of the overall length of the upper leg part.

6. A table according to claim 5, wherein said platelike worksurface has cutout recesses formed therein adjacent rear corners thereof, and each said leg having the respective upper leg part positioned so as to project upwardly through a respective one of the corner cutout recesses so that the upper leg part projects above the top surface of the worksurface.

* * * * *